US007077737B2

(12) United States Patent
Manigel

(10) Patent No.: US 7,077,737 B2
(45) Date of Patent: Jul. 18, 2006

(54) FLEXIBLE FILE AND FILE DISPENSER SYSTEM

(76) Inventor: Guenter Manigel, 1723 Sterling Rd., Sycamore, IL (US) 60178

( * ) Notice: Subject to any disclaimer, the term of this patent is extended or adjusted under 35 U.S.C. 154(b) by 65 days.

(21) Appl. No.: 10/444,263

(22) Filed: May 23, 2003

(65) Prior Publication Data

US 2004/0234346 A1 Nov. 25, 2004

(51) Int. Cl.
*B24D 11/00* (2006.01)

(52) U.S. Cl. ..... 451/533; 451/524; 451/527; 451/528; 451/529; 451/531; 451/532; 451/534; 451/535

(58) Field of Classification Search ..... 451/526, 451/527, 528, 529, 531, 532, 533, 534, 535
See application file for complete search history.

(56) References Cited

U.S. PATENT DOCUMENTS 3,318,318 A * 5/1967 Gewirz ..... 132/76.4
4,361,990 A 12/1982 Link
4,416,410 A 11/1983 Herrmann
4,825,597 A 5/1989 Matechuk
5,140,785 A * 8/1992 Eleouet ..... 451/523
5,514,028 A 5/1996 Ali et al.
5,730,644 A 3/1998 Pfanstiehl
5,975,988 A 11/1999 Christianson
6,006,413 A * 12/1999 Farley ..... 29/459
6,099,603 A 8/2000 Johnson
6,207,246 B1 * 3/2001 Moren et al. ..... 428/43
6,261,031 B1 7/2001 Stipe et al.
6,406,365 B1 6/2002 Ueno
6,428,407 B1 * 8/2002 Elder ..... 451/530
6,439,988 B1 8/2002 Long et al.

* cited by examiner

*Primary Examiner*—Joseph J. Hail, III
*Assistant Examiner*—Shantese McDonald
(74) *Attorney, Agent, or Firm*—Clifford Kraft

(57) ABSTRACT

A flexible file system for providing abrasive files that can be used for wood or metal working that can be supplied in different sizes, stiffness and with different types of abrasive surfaces in different cross-sections. These flexible files can be attached to form a web that can be loaded into a dispenser either on a spindle or folded for easy dispensing of files as they are needed. The dispenser can have optional blades for separating the files as they are dispensed. Various methods can be used to attach the files into a web for easy dispensing and later separation including attach strips with cut or break points.

17 Claims, 11 Drawing Sheets

FLEXIBLE FILE AND FILE DISPENSER SYSTEM

BACKGROUND

1. Field of the Invention

The present invention relates generally to the field of abrasion and more particularly to a flexible file and file dispenser system.

2. Description of the Prior Art

Prior art systems have provided sandpaper and files for a variety of applications. Normally files are made of metal and cut to various lengths and thicknesses while sandpaper is generally made by attaching an abrasive material to one or more surfaces of a sheet of paper. Both files and sandpaper can be found with different levels of abrasiveness.

It is known in the art to supply kits containing sandpaper for different special purposes. U.S. Pat. No. 5,730,644 teaches a kit for repairing paint blemishes where sandpaper is supplied in small strips. These strips can be kept in special containers or in a matchbook-like holder.

It is also known in the art to mount sandpaper on sanding blocks of various shapes or in different types of holder tools. It is also known in the art to dispense sandpaper from roles. U.S. Pat. No. 4,361,990 teaches a sandpaper holder tool that is an example of tools known in the art.

The great problem with prior art files and sandpaper is that files are too rigid to get into tight spaces to perform fine wood or metal finishing. On the other hand, sandpaper, while flexible, is unwieldy and also difficult to use in a tight space. When sandpaper is mounted on a tool or block, the sandpaper becomes totally rigid and again unusable in tight spaces where flexibility is necessary.

What is needed is a flexible file that has a surface like sandpaper but more rigid than a piece of sandpaper, yet less rigid that a metal file. This flexible file should allow a solution where one can sand or file in a tight space under controlled pressure. These flexible files could be supplied in a web that is dispensed from a handy dispenser or any other convenient dispensing means.

SUMMARY OF THE INVENTION

The present invention relates to a system of flexible files made by putting an abrasive layer on one or more surfaces of an elongated semi-rigid member and a means of containing them and dispensing them. These flexible files can be used efficiently in tight spaces with controlled pressure. The abrasive layer can be made from discrete embedded abrasive materials like that of sandpaper, or could be a separate layer of sandpaper or other abrasive material. Any means of creating an abrasive surface is within the scope of the present invention. The resulting flexible file can have abrasive material on any or all surfaces. The tool allows a user to apply abrasion (such as one would with sandpaper) in very tight places where, under normal circumstances, unsupported sandpaper would yield to applied pressure and become useless. The preferred method is to supply the flexible file with abrasive surfaces on both top and bottom; however, different versions or embodiments of it may have abrasive material only on one side, or on all sides.

Each flexible file can be attached to other similar files to form a web. Attachment can be made with strips of plastic or other material with or without cut or break points. The web can be wound on a spindle and placed into a convenient dispenser. The dispenser can be equipped with a knob for easy rolling out of files. Each file can be broken off or cut off when needed. Optional blades can be provided on the dispenser to cut off the files.

The dispenser can optionally be easily opened and reloaded with a new web of flexible files. In this way, the files can be supplied or sold either in the dispenser or as re-load webs for the dispenser.

Flexible files can be supplied in many different lengths, shapes, cross-sections, grades of stiffness and abrasiveness. Different containers containing files with different abrasiveness or other properties could be stacked or other wise attached and can be color-coded for identification. Also, the web of files can be color-coded or otherwise coded to indicate the abrasiveness and grade of stiffness.

Thus, it is an object of the present invention to provide a tool in practical shape and size to apply abrasion in tight places or in any filing application.

It is another object of the present invention to provide files of varying stiffness to meet different filing requirements.

It is another object of the present invention to supply this tool in a useful manner with a practical storage unit and dispenser with an optional storage unit for used files.

Finally, it is an object of the present invention to provide a system of flexible files and their dispensing means that is easy to manufacture and assemble, and can thus be sold at a reasonable price.

DETAILED DESCRIPTION OF THE INVENTION

The present invention relates to a flexible file design as well as a system for dispensing these files. Each flexible file is a semi-rigid strip that contains abrasive material on one or more surfaces. The files can be attached side-by-side to form a web which can be dispensed in a specially designed dispenser. The files can be designed so that each file can be broken loose or otherwise detached from the web as it exits the dispenser. Files can have different predetermined stiffness with some files being very flexible and others being fairly rigid. Files of different stiffness and different grades of abrasiveness can be color coded.

Figure 1:
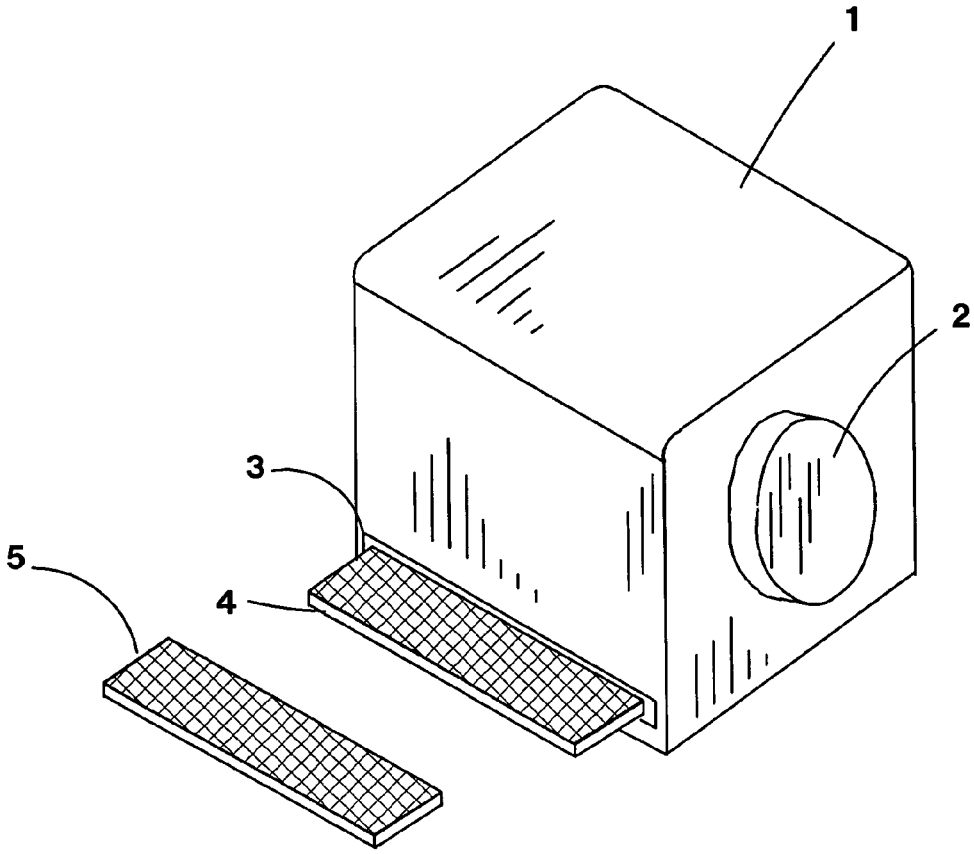
FIG. 1 shows an embodiment of a flexible file dispenser.
Figure 2:
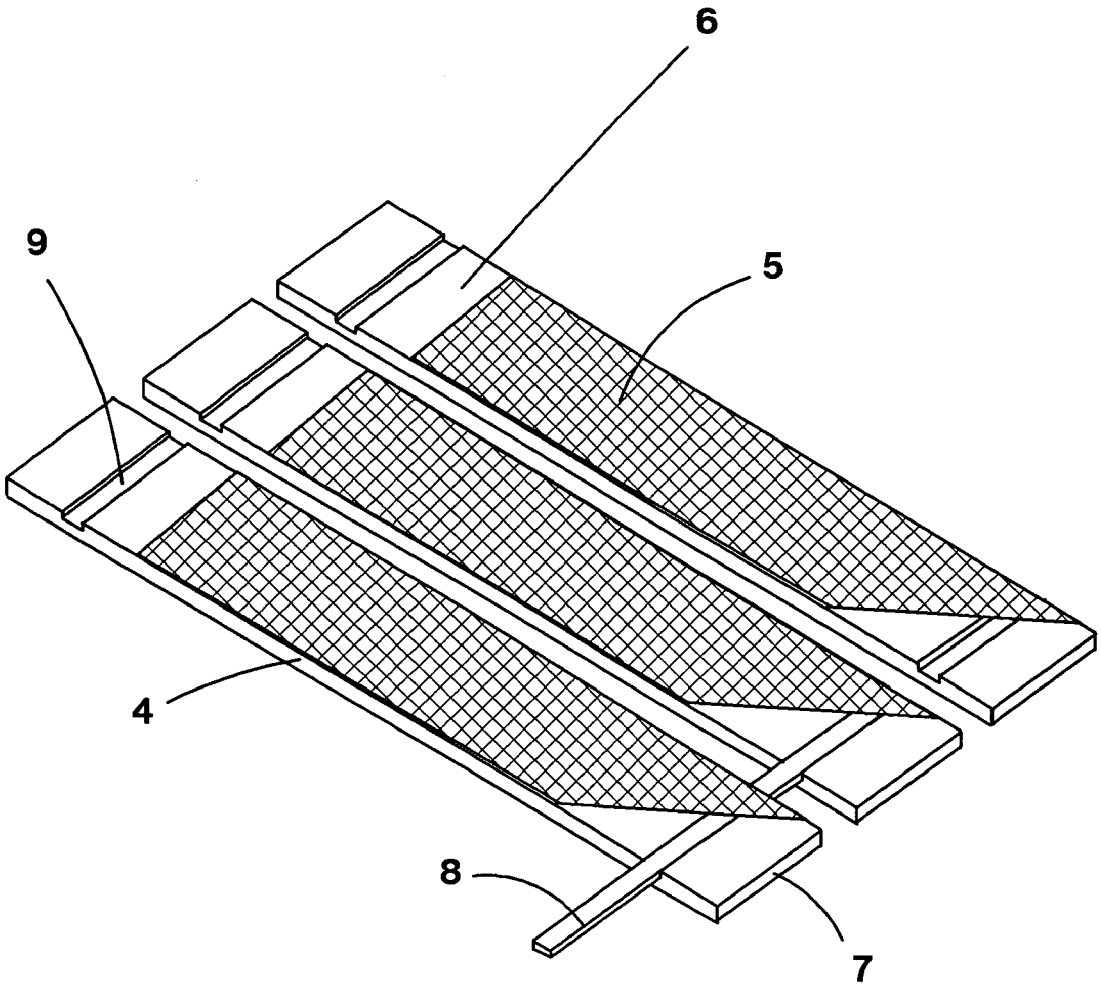
FIG. 2 shows several flexible files of one type attached together in a web for dispensing.

An example of the design of a suitable dispenser can be seen in FIG. 1 while an example of a web of flexible files can be seen in FIG. 2. A case 1 that can be plastic or any other material holds a roll of flexible files 4 that can be dispensed by turning a knob 2. The file strips can exit the dispenser from a small slit or opening 3. Each flexible file can generally be an elongated piece of semi-rigid support material 6 (FIG. 2) with abrasive 5 on one or more surfaces. In the preferred embodiment, abrasive 5 appears on both a top and bottom surface. It should be noted that abrasive can appear on any surface of the flexible of file including all-around. In addition, the entire file can be made from an abrasive material. In this case, the abrasive action continues as the file wears.

The preferred material for the dispenser is plastic; however, wood, metal or any other material is within the scope of the present invention. It should be noted that while FIG. 1 shows the dispenser to be of generally rectangular shape, any other shape is within the scope of the present invention, in particular a cylindrical shape.

Figure 14:
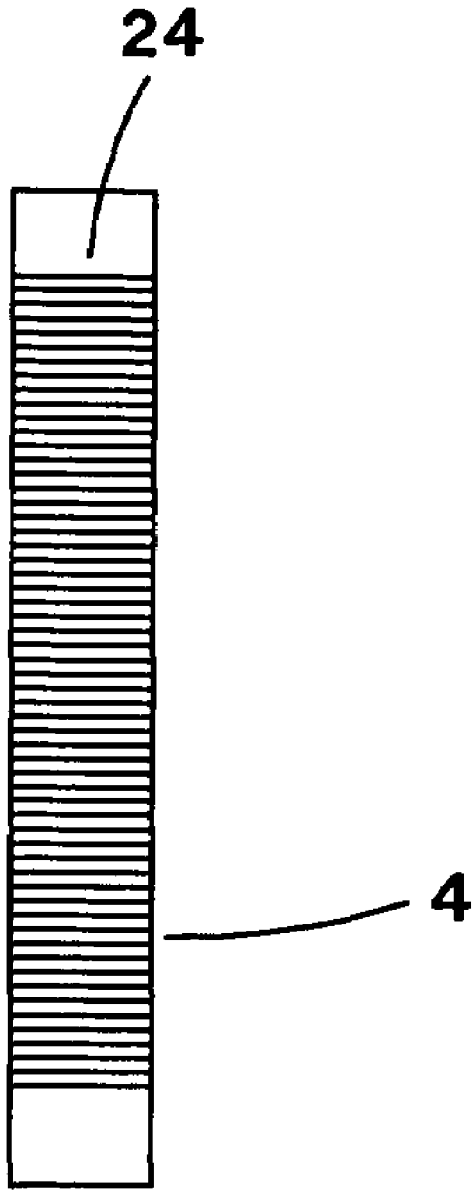
FIG. 14 shows an embodiment of the file where the abrasive is in the form of ridges.

The semi-rigid support member 6 can have abrasive material 5 embedded in it, or a surface layer of abrasive material can be glued to it or otherwise attached. Any attachment method may be used. The abrasive material 5 can be made of discrete particles such as the case of sandpaper, or it can be made from ridges 24 cut into the semi-rigid member (shown in FIG. 14). Any manner or method of providing an abrasive surface is within the scope of the present invention. If glue is used to hold abrasive material on the surface of the semi-rigid support member, it can be urethane or epoxy based or any other type of glue or adhesive.

The flexible files of the present invention can be supplied with many different grades of abrasion just like regular files or sandpaper, and with different grades of stiffness and abrasiveness. The abrasive can be omitted from one side or can vary from side to side. Ends as well as sides can optionally contain abrasive. Some applications can benefit from files that are quite stiff, while others may need files that are very flexible. Any grade or degree of flexibility is within the scope of the present invention. The files or connecting material can be color-coded, or otherwise coded, to show both stiffness and degree of abrasiveness.

A preferred size for the flexible files could be 6–12 inches with thicknesses from 0.0625 inches to 0.125 inches and widths of 0.125–1.0 inches. It should be noted that these dimensions are by way of example only. Any shape or dimensions of the flexible files are within the scope of the present invention.

The illustrations herein generally show the flexible files to be rectangular in shape; however, this is for example only. Any shape for such files is within the scope of the present invention. This includes, but is not limited to, squares, triangles, elongated shapes with rounded ends, and any other possible shape. In particular, the ends of the files do not need to be rectangular and can be rounded or pointed.

A quantity of flexible files can be placed side-by-side to form a web as shown in FIG. 2. Various methods for attaching the files to each other are possible. One method is to attach the files 6 together with a strip of connecting material 8. The connecting material strip 8 could be attached to the side or end 7 of the file or run in a set of grooves 9 that could be cut into the elongated file. The preferred connecting material is plastic; however, it can be fibrous material of any type natural or synthetic, metal or any other material thin enough to freely flex. In particular, the connecting material can be paper or fiber, thermoplastic, metal or woven fabric.

The connecting means can be manufactured to break or tear, or optional blades can be attached to the dispenser or otherwise supplied to separate the dispensed files.

Figure 3:
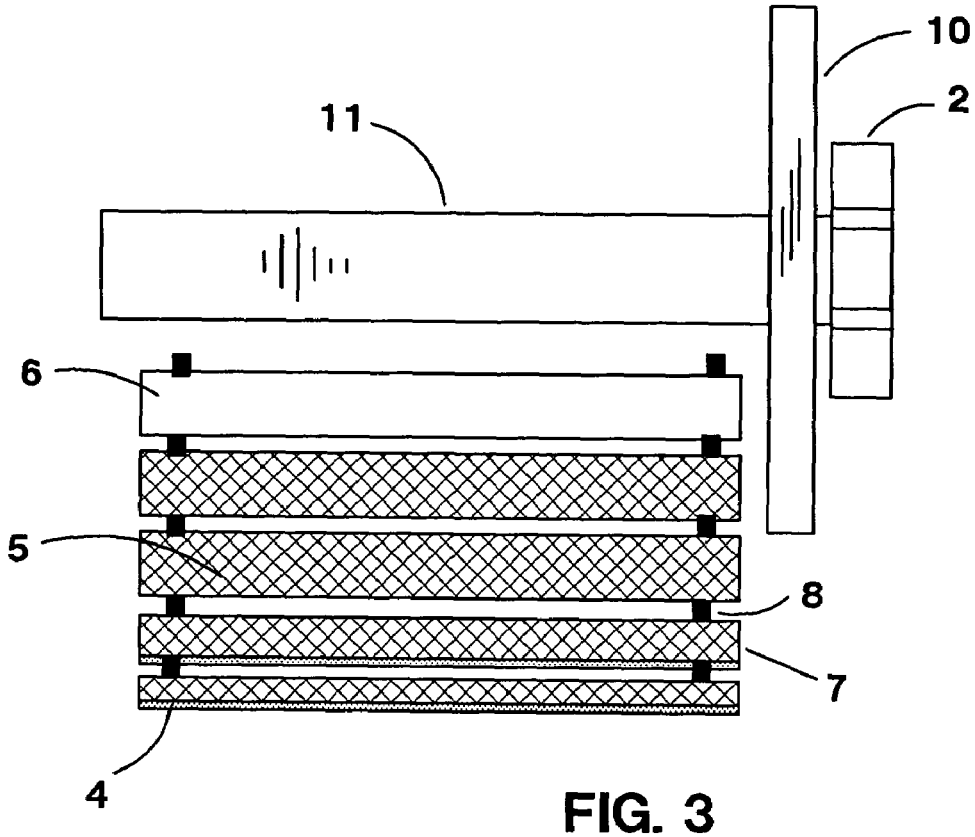
FIG. 3 shows details of an embodiment of a wind up dispenser roller.
Figure 4:
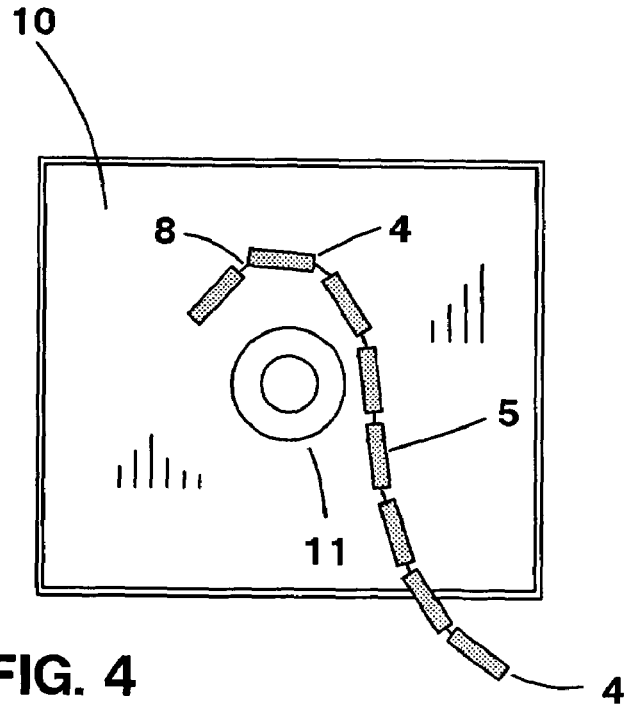
FIG. 4 shows a side view of the embodiment of FIG. 3.

Turning to FIG. 3, it can be seen that a web of flexible files can be wound on a spindle 11 as part of a dispensing device. A knob 2 connected to a side 10 of the dispensing device can turn the spindle 11 to dispense the files through a slot. Each file strip 6 can have one or more abrasive surfaces 5 and be attached to another file on one or more edges 4 with an attachment means 8. The attachment 8 can be on or near the end 7 of the file support strip 6. The exact diameter of the spindle and of the final spool is not important to the functioning of the present invention and can be any reasonable size. It should be remembered that it is not necessary to the functioning of the present invention that the web of files be wound. It can be folded or placed in the dispenser in any other manner that provides for easy dispensing and loading.

Figure 5:
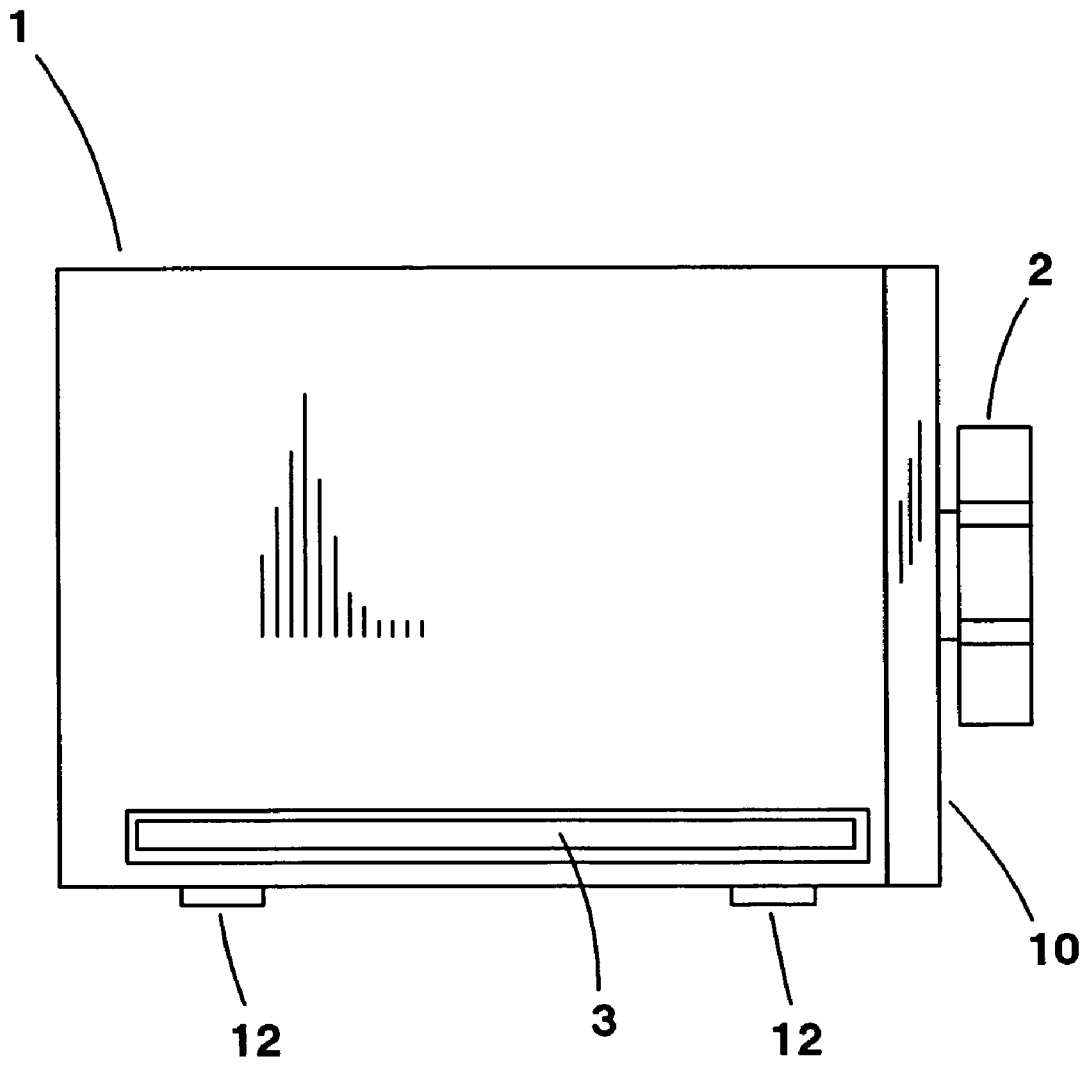
FIG. 5 shows a side view of the file dispenser of FIG. 1 including cutting blades.

Various methods can be used to remove the flexible files from the web as they are being dispensed. FIG. 5 shows an example of one such method. The dispenser body 1 can contain a slot 3 where the files are dispensed. Under this slot 3, one, two or more small blades 12 can be mounted so that the user can simply pull the file downward as it is dispensed to cut it loose. It should be noted that the optional blades 12 can be mounted anywhere on the dispenser that is convenient or can be supplied separately from the dispenser. Other methods can include providing break-apart points in the strips that are used to hold the files together. It should also be noted that the blades 12 can be integrated inside the dispenser body during injection molding with the blades 12 and dispenser body being of the same material.

Figure 6:
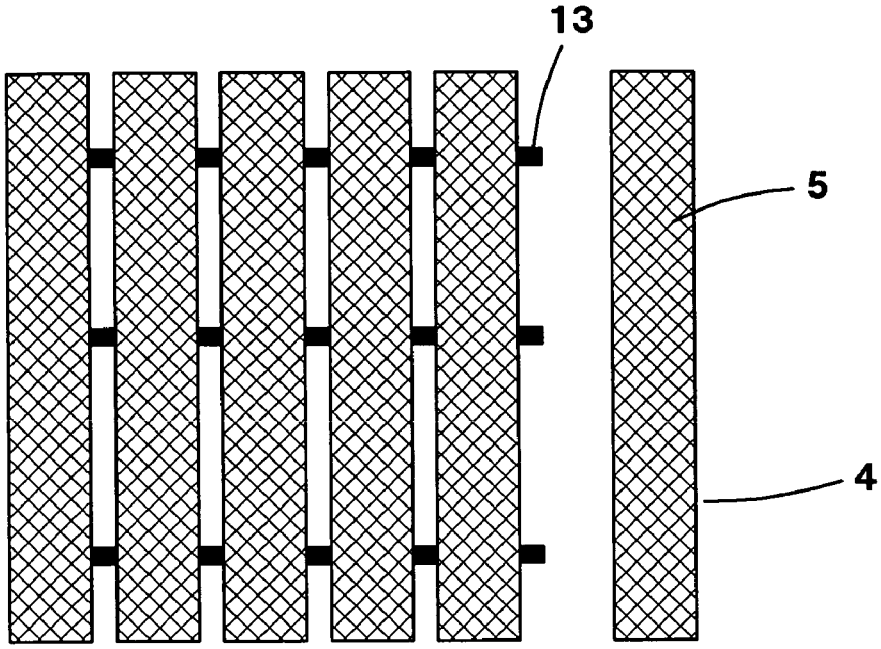
FIGS. 6–8 show alternative embodiments of fastening methods for flexible files.
Figure 7:
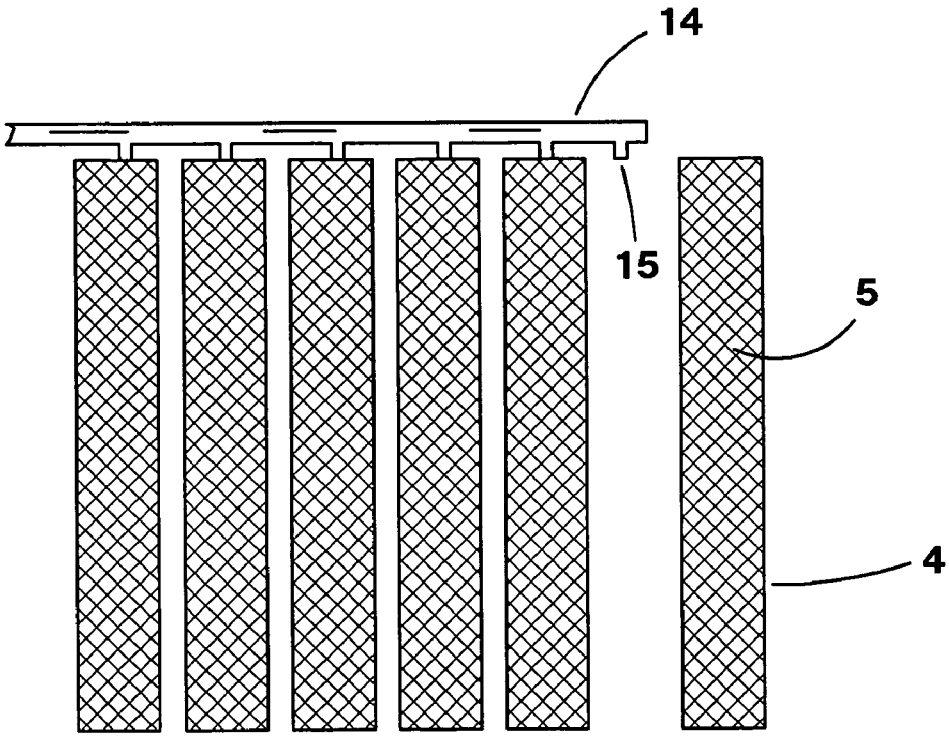

Many other methods of connecting the files into a web can be used and are within the scope of the present invention. FIGS. 6–7 show alternative embodiments. Break strips 13 can be connected into the edges of the flexible files. This can be done in one or several rows as shown in FIG. 6. The break strips can have indentations (not shown) between the files so that the will break smoothly or they can be uniform and be cut by blades 12 shown in FIG. 5. In addition, the files can be attached to one-another along the end of each file as is shown in FIG. 7. Here, the break strips 14 are possibly cut so that the file pulls away from the break-strip at the attach point 15.

Figure 8:
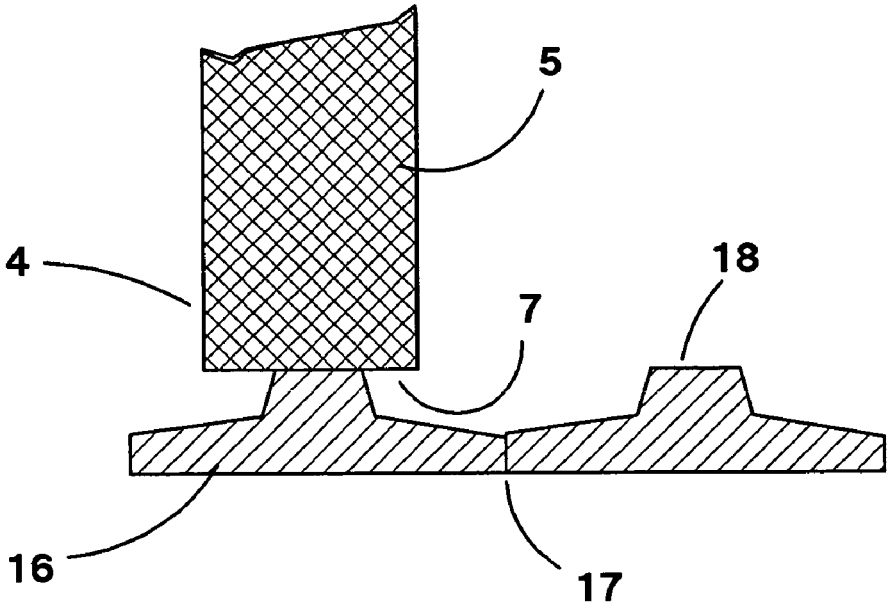

FIG. 8 shows an alternate design for the type of break strip that runs along the edge of the flexible files. Here, the break strip 16 attaches to the edge of the file 7 on the end at an attach point 18. However, in this case, the break strip contains a preferred break point 17 that allows it to break between two files.

Figure 9A:
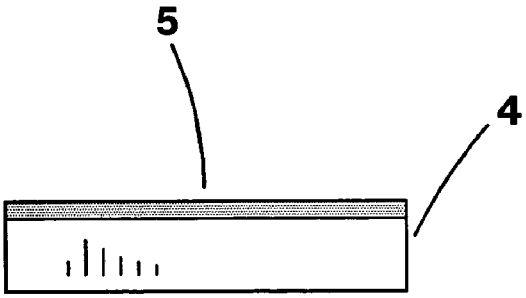
FIG. 9A-9C show alternative embodiments of abrasive patterns on a flexible file.
Figure 9B:
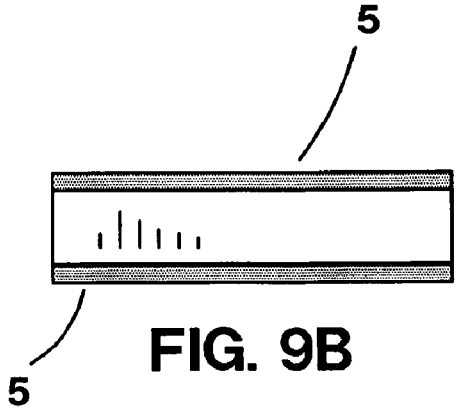
Figure 9C:
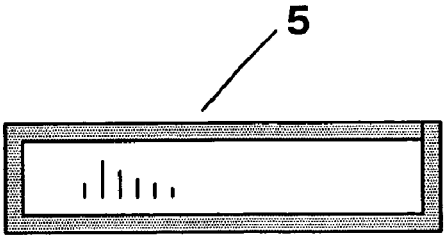
Figure 10A:
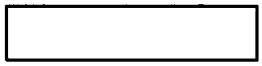
FIGS. 10A–10H show alternative cross-sections for flexible files.
Figure 10B:
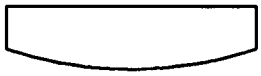
Figure 10C:
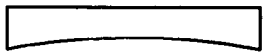
Figure 10D:
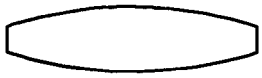
Figure 10E:
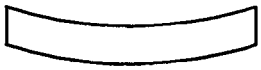
Figure 10F:
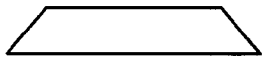
Figure 10G:
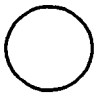
Figure 10H:
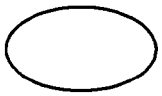

Flexible files can have abrasive 5 on one surface such as shown in FIG. 9A, on a top and bottom surface such as shown in FIG. 9B or all around such as shown in FIG. 9C. Any arrangement or location of abrasive material is within the scope of the present invention.

Flexible files can have any cross-section. FIGS. 10A–10H show different possible file cross-sections. It should be remembered that the examples shown in FIG. 10 which include rectangular, convex, concave, trapezoidal, circular and elliptical cross-sections are for example only. Any cross-section of the flexible file is within the scope of the present invention. Again, different files can be color-coded, or otherwise coded, to indicate their cross-section.

Figure 11A:
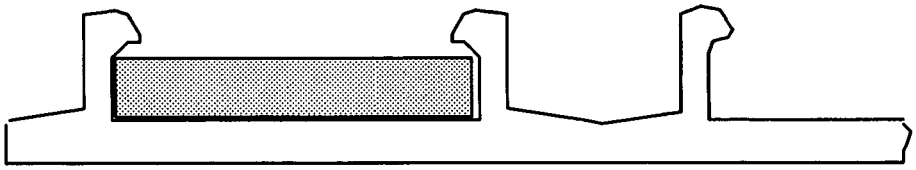
FIGS. 11A–11B show a side view of an alternative method of connecting files in a web.
Figure 11B:
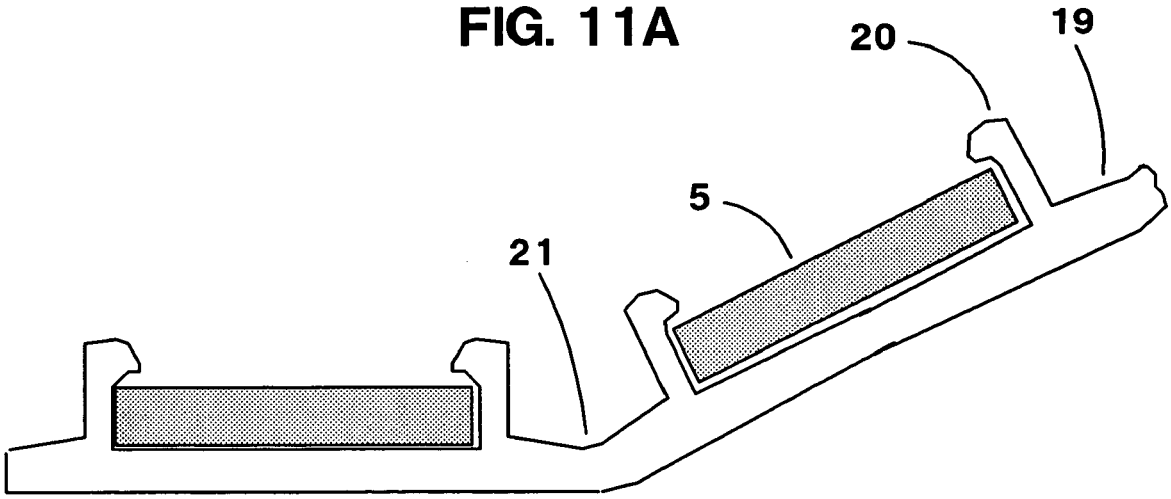
Figure 12:
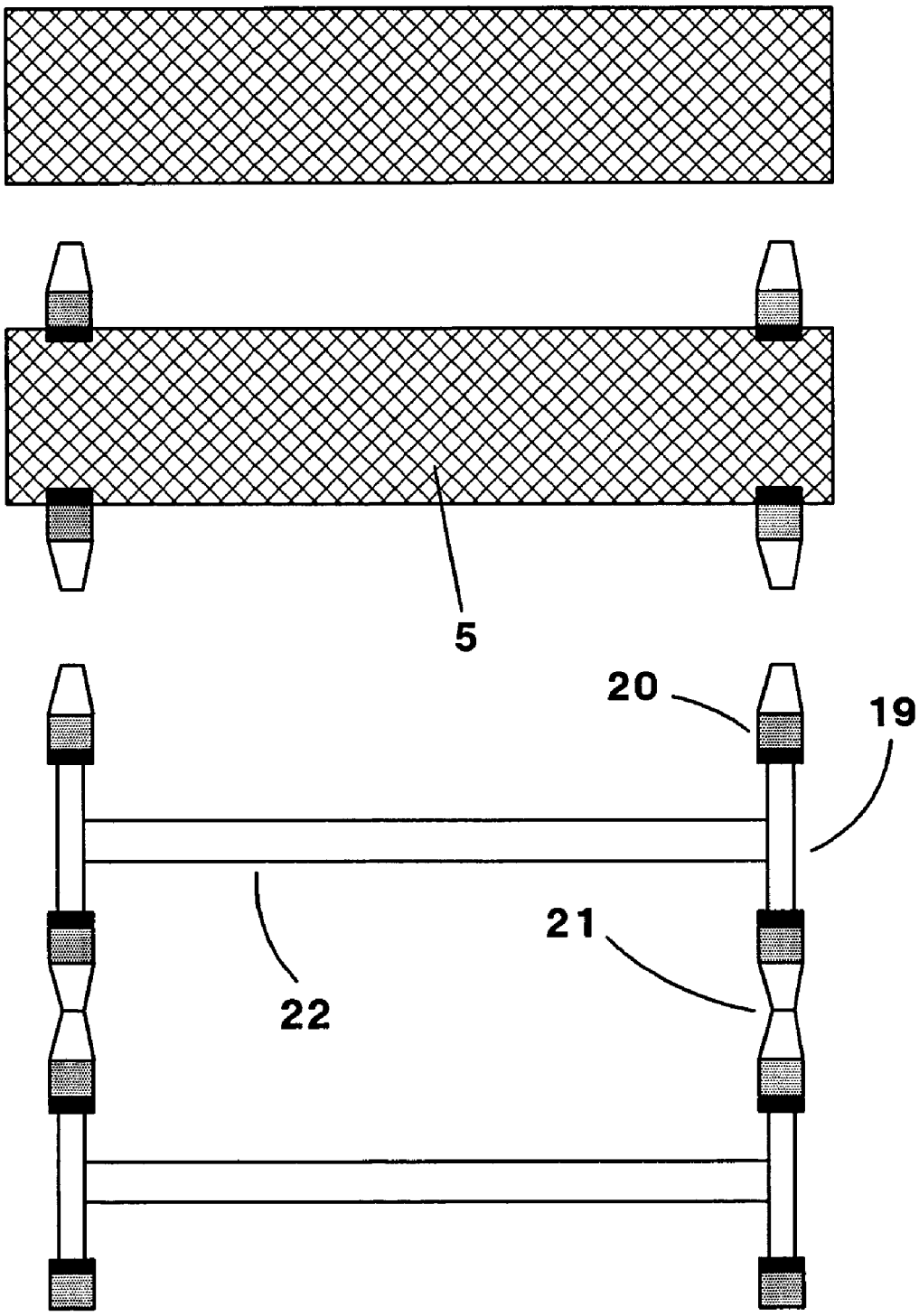
FIG. 12 shows a top view of the embodiment of FIGS. 11A–11B.

FIGS. 11A–11B show an alternative embodiment of a means of holding the files together in a web. FIG. 12 shows a top view of this embodiment. Fingers 20 hold the files 5 (with abrasive) in place in a flexible frame 19. The system can be designed to flex and/or break at predetermined break-points 21. The ends of the assembly 19 can be separated and supported by any type of support 22.

Figure 13A:
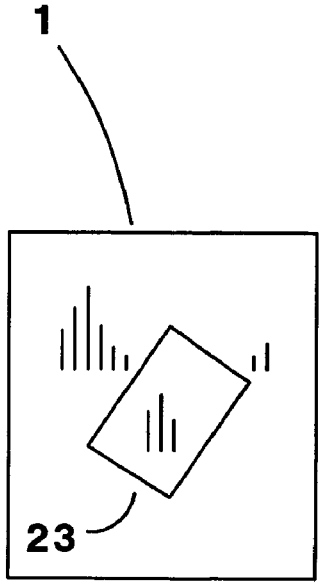
FIGS. 13*a* & *b* show an embodiment of the case with an optionally holding space for files or used files.
Figure 13B:
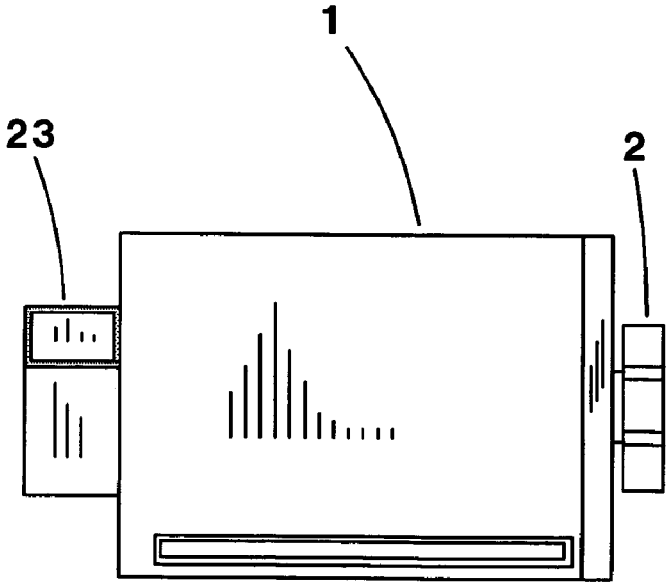

FIGS. 13*a* & *b* show an optional attachment 23 to the dispenser 1 that can hold used files. This attachment can take any form, a box shape being shown in FIGS. 13*a* & *b*. This attachment can take any form that performs the function of holding files.

The files described herein do not have to be connected together or dispensed by any special type of container. In fact, they could be supplied in tubes or bags or any other type of container.

It should be understood that various examples and figures have been presented to illustrate the concepts and principles that represent the present invention. It will be appreciated by one skilled in the art that many variations and changes are possible without deviating from the spirit or scope of the present invention.

I claim:

1. A flexible file system comprising:

a dispenser that dispenses flexible file strips from a web wound on a spindle inside said dispenser;

an elongated semi-rigid support member, said support member having attachment means for attaching it to another similar support member;

an abrasive distributed on at least one surface of said semi-rigid support member.

2. The flexible file system of claim 1 further comprising abrasive on a top and bottom surface of said semi-rigid support member.

3. The flexible file system of claim 1 further comprising abrasive on side surfaces of said semi-rigid support member.

4. The flexible file system of claim 1 further comprising a container attached to said dispenser for holding used files.

5. The flexible file system of claim 1 wherein said dispenser is color-coded to indicate abrasiveness or stiffness of said files.

6. The flexible file system of claim 1 wherein said abrasive is a sandpaper layer.

7. The flexible file system of claim 6 wherein said sandpaper layer is glued to said semi-rigid member.

8. The flexible file system of claim 1 wherein said abrasive comprises ridges in said semi-rigid member.

9. The flexible file system of claim 1 wherein said elongated semi-rigid member is plastic.

10. A flexible file system with a dispenser that dispenses flexible filestrips from a web wound on a spindle inside said dispenser, each of said file strips comprising:

an elongated semi-rigid support member, said support member having attachment means for attaching it to another similar support member;

an abrasive distributed on at least one surface of said semi-rigid support member.

11. The flexible file system of claim 10 wherein said abrasive is a sandpaper layer.

12. A flexible file system comprising, in combination:

a plurality of flexible file strips, each file strip having at least one abrasive surface, said file strips connected to form a web;

a dispenser containing said flexible web and dispensing file strips from said web to a user one-by-one;

a spindle inside said dispenser, said flexible web being wound on said spindle.

13. The flexible file system of claim 12 wherein said abrasive surface is sandpaper.

14. The flexible file system of claim 12 wherein said abrasive surface comprises a plurality of ridges in said surface.

15. The flexible file system of claim 12 wherein said file strips are plastic.

16. The flexible file system of claim 12 further comprising a container attached to said dispenser, said container holding used files.

17. The flexible file system of claim 12 further comprising a means for holding files attached to said dispenser means.

* * * * *